US005494347A

United States Patent [19]

Poortvliet et al.

[11] Patent Number: 5,494,347

[45] Date of Patent: Feb. 27, 1996

[54] HAND OPERATED ACTUATOR FOR ROTARY STORAGE CABINET

[75] Inventors: Robert J. Poortvliet, Jenison, Mich.; Michael L. Murphree; Thomas A. Bursh, both of Naperville, Ill.

[73] Assignee: White Consolidated Industries, Inc., Cleveland, Ohio

[21] Appl. No.: 222,406

[22] Filed: Apr. 1, 1994

[51] Int. Cl.[6] ..... A47B 46/00

[52] U.S. Cl. ..... 312/270.2; 312/249.2

[58] Field of Search ..... 312/249.2, 270.2, 312/305

[56] References Cited

U.S. PATENT DOCUMENTS

| | | | |
|---|---|---|---|
| 3,868,157 | 2/1975 | Robinson | 312/305 |
| 4,229,060 | 10/1980 | Brownlee et al. | 312/305 |
| 4,258,966 | 3/1981 | Grubb, Jr. | 312/305 |
| 4,509,676 | 4/1985 | Stacy . | |
| 4,610,492 | 9/1986 | Molander et al. | 312/305 |
| 5,312,181 | 5/1994 | Hudnall | 312/249.2 |

*Primary Examiner*—Peter M. Cuomo
*Assistant Examiner*—Robert J. Sandy
*Attorney, Agent, or Firm*—Pearne, Gordon, McCoy & Granger

[57] ABSTRACT

A rotary cabinet with a self-latching and positioning rotor is provided with an improved latch mechanism. The latch is operated by a sliding hand actuator connected by links and levers to a latch member. To operate, the actuator is lifted to release the rotor. An air cylinder retards the return of the actuator and latch member to the latched position. While the rotor is released, the rotor is rotated to a desired position. The latch returns to the latched position and restrains the rotor. Materials can be stored in or retrieved from shelves on the rotor.

26 Claims, 4 Drawing Sheets

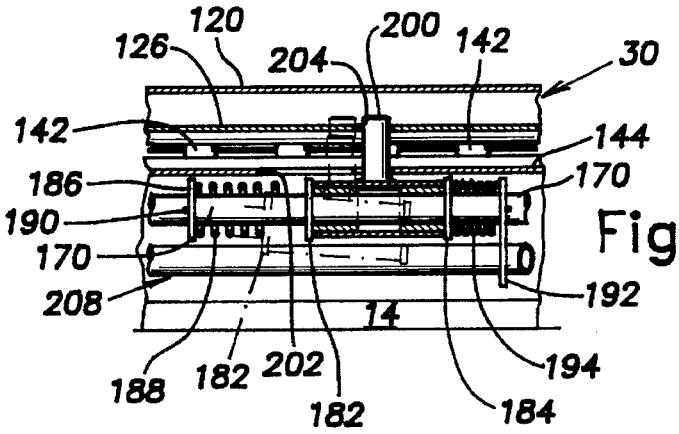
Fig.6
Fig.8
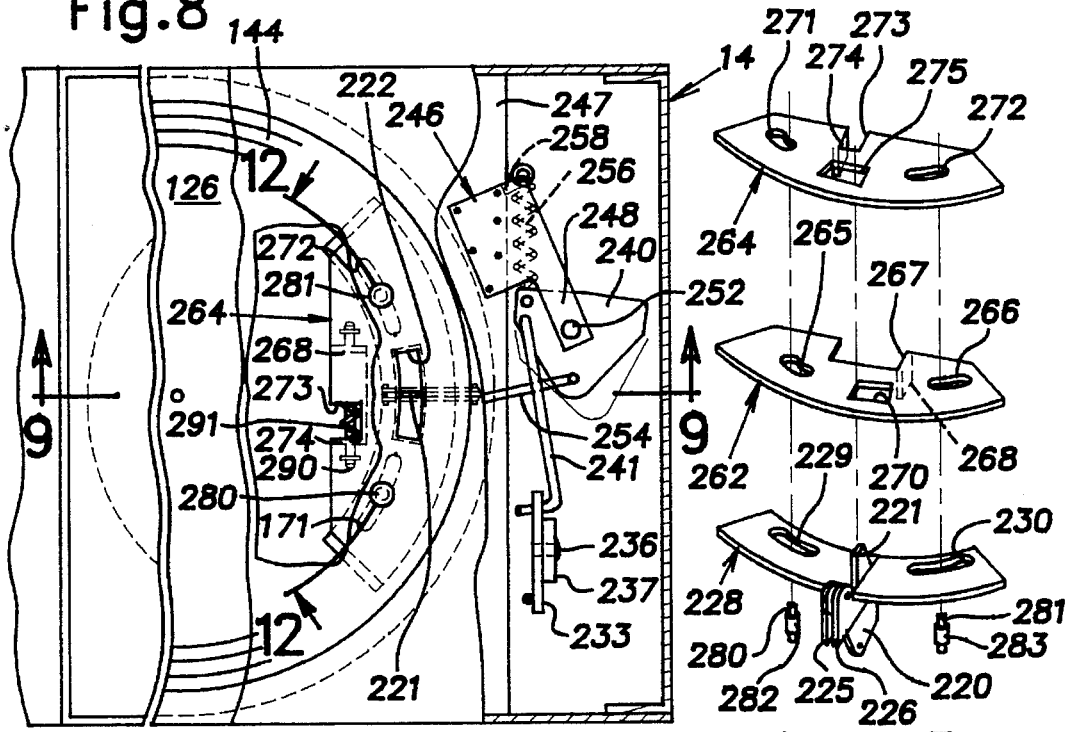
Fig.13
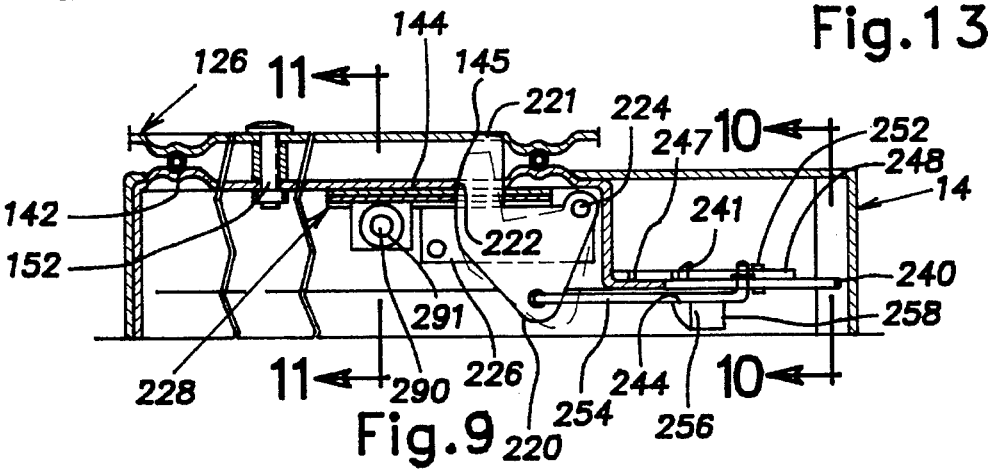
Fig.9

HAND OPERATED ACTUATOR FOR ROTARY STORAGE CABINET

BACKGROUND OF THE INVENTION

This invention relates generally to rotary filing cabinets and specifically to an improved latching device for such cabinets.

Uses and advantages of filing cabinets having rotary storage unit mounted in a stationary frame are well known. U.S. Pat. No. 3,868,157, incorporated herein by reference, shows such a filing cabinet. Books, files, or other materials are kept in the storage unit.

In a preferred form of the prior art, the cabinet is constructed in modules which can be joined together. Each module comprises a cabinet having within it a rotor having a platform or shelf structure with the rotor rotatable about a vertical axis in the cabinet. The cabinet is preferably rectilinear having two opposite open sides. The rotor structure has a plurality of supporting shelves or platforms for files and two such arrays are provided in the rotor structure so that by turning the rotor, either array can quickly be exposed to either open side of the cabinet. In other words, there is a double bank or array of filing space, either bank of which is readily exposable to either of the open sides of the cabinet.

The shelf or platform support structure, that is, the rotor, is square and has two smooth flat sides so that the rotor can be turned to a position in which these two flat sides form a closure for the open sides of the cabinet. The result is a smooth, neat, compact appearance when the cabinet is closed.

Through a system of rods, springs and levers, the rotor is positioned and locked in a desired position. A foot pedal operates the locking system. When the pedal is depressed, the rotor rotates freely. When the pedal is released, the rotor is locked in one of several predetermined positions.

Other rotary cabinets having locking and positioning systems are known in the prior art. For example, U.S. Pat. Nos. 4,229,060 to Brownlee et al. and 4,258,966 to Grubb, Jr. show a rotary cabinet having separate locking and positioning systems. A wheel on a spring biased lever is urged into one of four detents on a rotor base of the unit. The wheel resists movement of the rotor. The rotor and storage unit are locked in place by a key operated pin which is moved into a slot around the rotor to prevent turning of the rotor.

U.S. Pat. Nos. 4,509,676 to Stacy and 4,610,492 to Molander show other rotary cabinets and locking mechanisms therefor.

In the light of the foregoing, the objects of the invention will be apparent. The primary object is to make available a double-bank file structure in the form of a cabinet as described, comprising a rectilinear module having a shelf or platform structure in it in the form of a rotor having back-to-back shelf spaces, either of which can be quickly turned to be exposed to either open side of the cabinet.

A rotary cabinet having an improved positioning and locking mechanism which is easily operated and simplifies retrieval and storage of materials is desired, in particular, an improvement on the type of mechanism shown in the Robinson patent.

A further object resides in the provision of means for latching or restraining the rotor structure in position; for releasing and permitting rotation of it; and then snubbing or restraining the rotation and stopping and holding the rotor in predetermined positions.

A further object is to provide an improved, hand operated latching means comprising a floating assembly of a latching member, arcuate sliding plates, and a restraining spring that retards the arcuate motion of the rotor in either direction.

SUMMARY OF THE INVENTION

The present invention provides a latching device for a rotary type cabinet. An actuator has a generally vertically elongated link operatively connected to the actuator. A movable latch is adapted to engage between the cabinet and a rotor of the cabinet so as restrain rotation thereof. A bias device is used for urging the latch toward its engaged position. A linkage is connected between the vertically elongated link and the latch to translate motion of the actuator so as to cause disengagement of the latch.

The latch engages the rotor so as to position the rotor. A hand operable handle is disposed on the actuator, which is vertically slidable. A delay mechanism comprising a piston disposed in an air cylinder, for example, retards return of the latch to its engaged position after disengagement.

The linkage includes an operating lever operatively connected to the actuator, and a generally horizontally disposed, elongated link having a first end operatively connected to the operating lever and a second end operatively connected to the latch so as to translate movement of the actuator to movement of the latch. The linkage may also include a lever plate operatively connected between the latch and the horizontal link so as to translate motion of the horizontal link in one direction to motion of the latch in another direction.

The latch is resiliently mounted so as to apply a resilient stopping force to the rotor when the latch engages the rotor. A resilient device urges the latch toward a neutral position when engaged with the rotor.

An improved rotary cabinet is also disclosed. The rotary cabinet includes a cabinet; a rotor adapted for storage and rotatably mounted in the cabinet; and a base above which the rotor is mounted. A latch mechanism for the cabinet includes a latch member mounted on the base and movable to a rotor engaging position so as to restrain movement of the rotor;a bias device urging the latch member toward its rotor engaging position; an actuator operatively connected to the latch so as to disengage the latch member by movement of the actuator, the actuator being vertically spaced above the base. The latch mechanism is essentially as described above.

The cabinet may also include a spring; a first member engageable by the latch member on lateral movement in one direction, the first member being attached to one end of the spring; a second member engageable by the latch member on lateral movement in the opposite direction and attached to the opposite end of the spring; and a stop limiting movement of the first and second members so that when either end of the spring is being compressed, the other end is restrained.

The members attached to the spring means include overlying first and second plates and further comprise an interconnection permitting limited relative movement of the plates and permitting limited lateral movement of the latch member. The interconnection comprises pins disposed through slots in the plates. A third plate on which the latch member is mounted underlies the first and second plates.

The cabinet has two sides opposite each other which are open; and the rotor comprises a rectilinear, support platform shelf mounted in the cabinet and rotatable about a vertical axis to positions so as to provide access thereto through either of the open sides. The cabinet also has a circular support track for the rotor and a plurality of shelves disposed on the rotor.

BRIEF DESCRIPTION OF THE DRAWINGS

FIG. 4 is a sectional view taken along the line 4—4 of FIG. 1;

FIG. 6 is a sectional view taken along the line 6—6 of FIG. 4;

FIG. 8 is a plan view partly broken away of the base section of a cabinet illustrating a form of latching mechanism according to another, preferred embodiment of the invention;

FIG. 9 is a sectional view taken along the line 9—9 of FIG. 8;

FIG. 1 is a view taken along the line 10—10 of FIG. 9;

FIG. 13 is an exploded perspective view of plate members constituting part of the latching mechanism.

DESCRIPTION OF THE PREFERRED EMBODIMENTS

Figure 1:
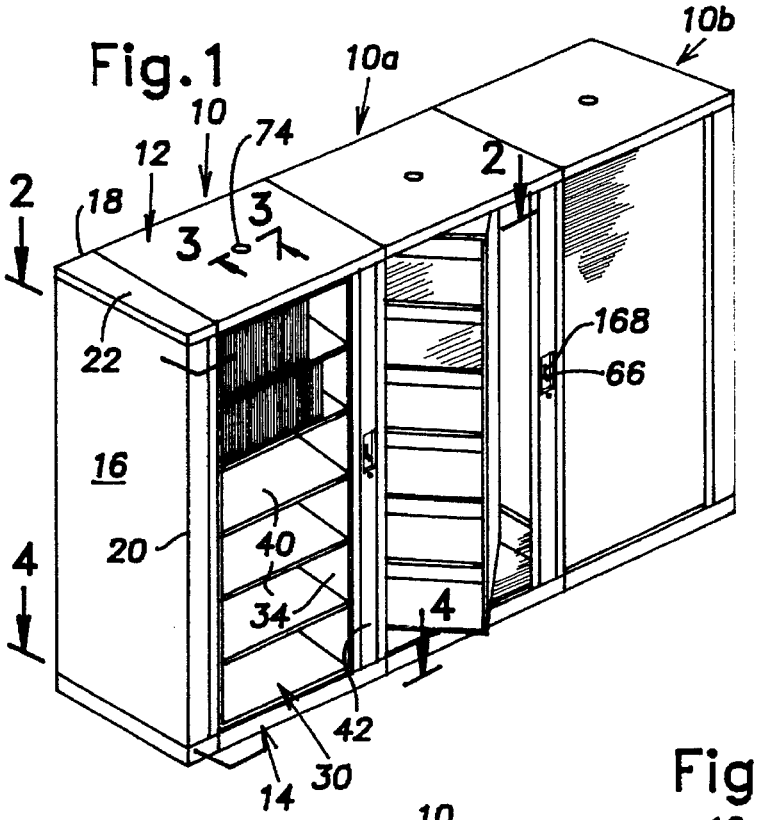
FIG. 1 is a perspective view of one embodiment of the invention shown as a cabinet formed of three modules.
Figure 2:
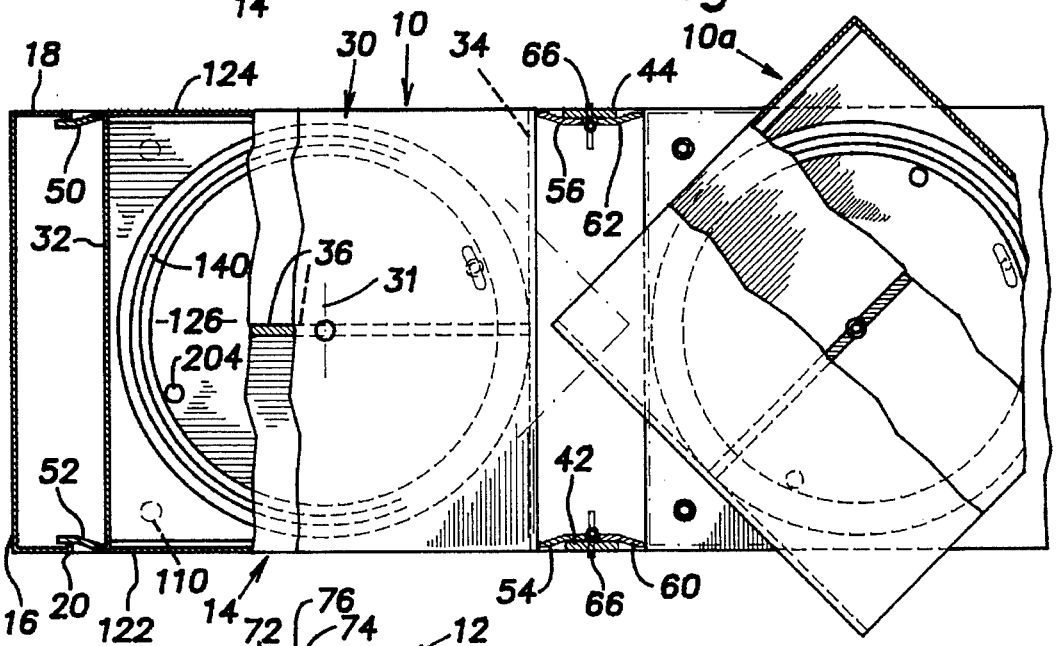
FIG. 2 is a sectional view taken along the line 2—2 of FIG. 1.

Referring now to the drawings, particularly FIGS. 1 and 2, FIG. 1 shows a cabinet structure comprising three cabinet modules 10, 10*a*, and 10*b* which are aligned and joined together. They may be held together in a unitary structure by any suitable or convenient means. The module 10 as shown is rectilinear in configuration and, in the preferred form of the invention, is square in cross section. The cabinet may be formed of sheet metal, for example, or any suitable material and has a flat top 12. The module 10 has a rectangular base structure 14 as may be seen in FIG. 1 and as will referred to more in detail presently.

Numeral 16 designates an end panel or structure having side flange parts 18 and 20 which are flush with front and back faces of the module. The end panel 16 rests on a base structure 14. On its top is top end panel 22 which is flush against the top panel 12.

Mounted within the module is a rotor 30 which forms a shelf or platform support structure. In the form of the invention shown, the rotor 30 is square and rotates about a vertical axis 31. The rotor 30 has two, flat side closures 32 and 34. Extending between these closures is a center or intermediate partition 36, as shown in FIG. 2. On both sides of the partition and extending between the side walls 32 and 34 are a plurality of supporting shelves 40, platforms, or other support members.

Between the modules 10 and 10*a* and upstanding from the base structure are upright panels 42 and 44. The rotors are positioned so that when the rotors within the cabinets are rotated, their corners can move into a space in the cabinet between modules and into an end space provided by the end panel 16. Mounted on the flanges 18 and 20 of the end panel 16 are flexible sealing or closure members 50 and 52 which may be made of fabric. Similar closure or sealing members 54 and 56 are mounted on the upright panels 42 and 44. Additionally mounted on these panels are similar flexible seals or members 60 and 62 associated with the next module 10*a*.

Numeral 66 designates an actuator, the purpose of which will be described presently. It operates a latch mechanism for releasing the rotor 30 for rotation and for snubbing, stopping, and latching the rotor in a predetermined quadrant position to which it is rotated.

Figure 3:
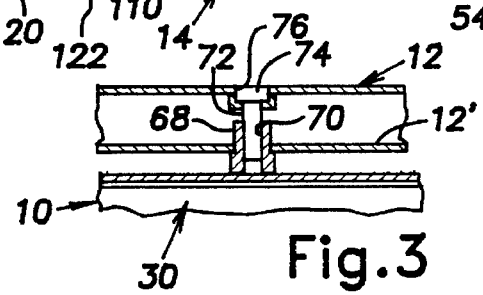
FIG. 3 is a detailed view of one of the mounting arbors or trunnions of the rotor structure taken along line 3—3 of FIG. 1.

Referring to FIG. 3, the top of the cabinet, that is, module 10, is double walled, the inner of the double walls being designated at 12'. Numeral 68 designates a bushing, in the form of a bearing which is supported at the center of the top of the rotor 30. It has a bore 70 which receives an axle or arbor 72 having a head 74 received in a recess 76 of the top wall 12. The axle or arbor is received in the bore 70 in the bushing 68 and forms a top trunnion about which the rotor 30 can rotate. There is a central pivot axle at the bottom of rotor 30 which will be referred to again presently.

Figure 7:
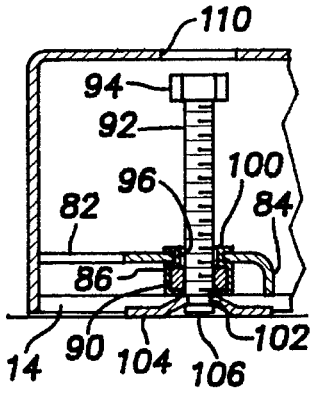
FIG. 7 is a detail sectional view showing one of the adjustable leveling feet for the cabinet structure.

FIG. 7 is a sectional view taken along the line 7—7 of FIG. 4 showing one of the adjustable supporting feet which are provided at corners of each module. At the corner of the base 14, there is a partition or support member 82 spaced from the bottom and having an edge support flange 84 as shown. A metal fitting 86 is shaped to receive a nut 90 through which extends a threaded stem 92 having a head 94. The fitting 86 has a neck part 96 which extends through an aperture or hole in the partition 82, at the end of which there is a flange 100 flush against the platform 82. The stem 92 has an end part 102 of smaller diameter. Fitting on this part, is metal foot member or support 104 which is held on by a flange 106 on the part 102 of smaller diameter. As may readily be seen, access may be had to the head 94 of the threaded stem, through an opening 110 in the top wall of the base section. The stem may be rotated so to adjust the vertical supporting position of the foot member 104.

Figure 5:
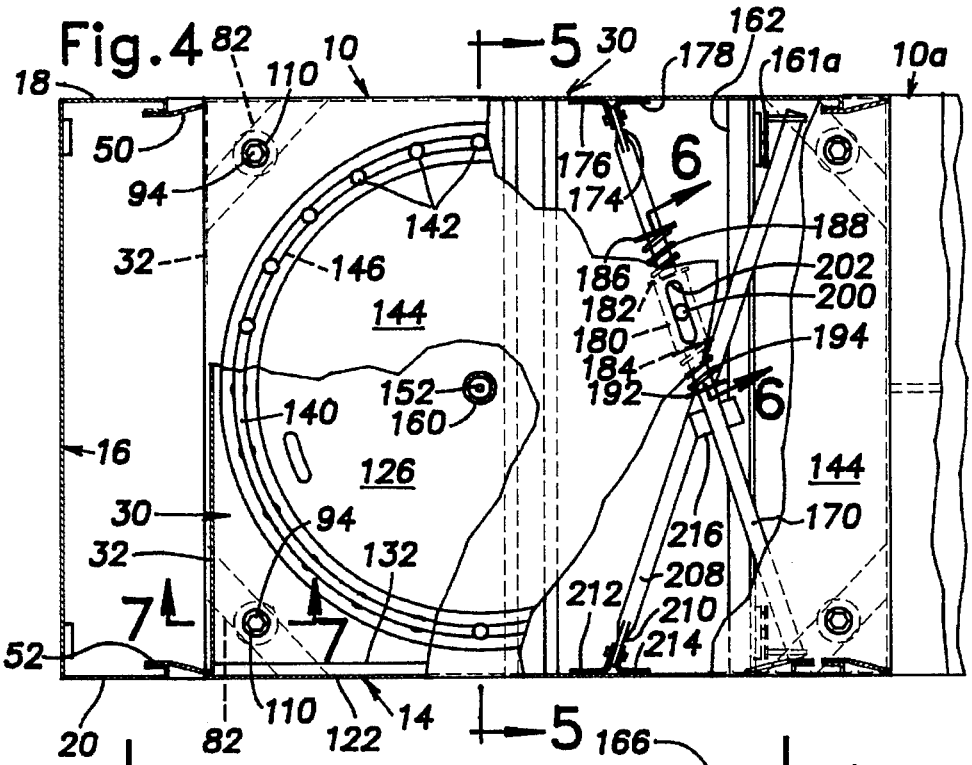
FIG. 5 is a sectional view taken along the line 5—5 of FIG. 4.
Figure 10:
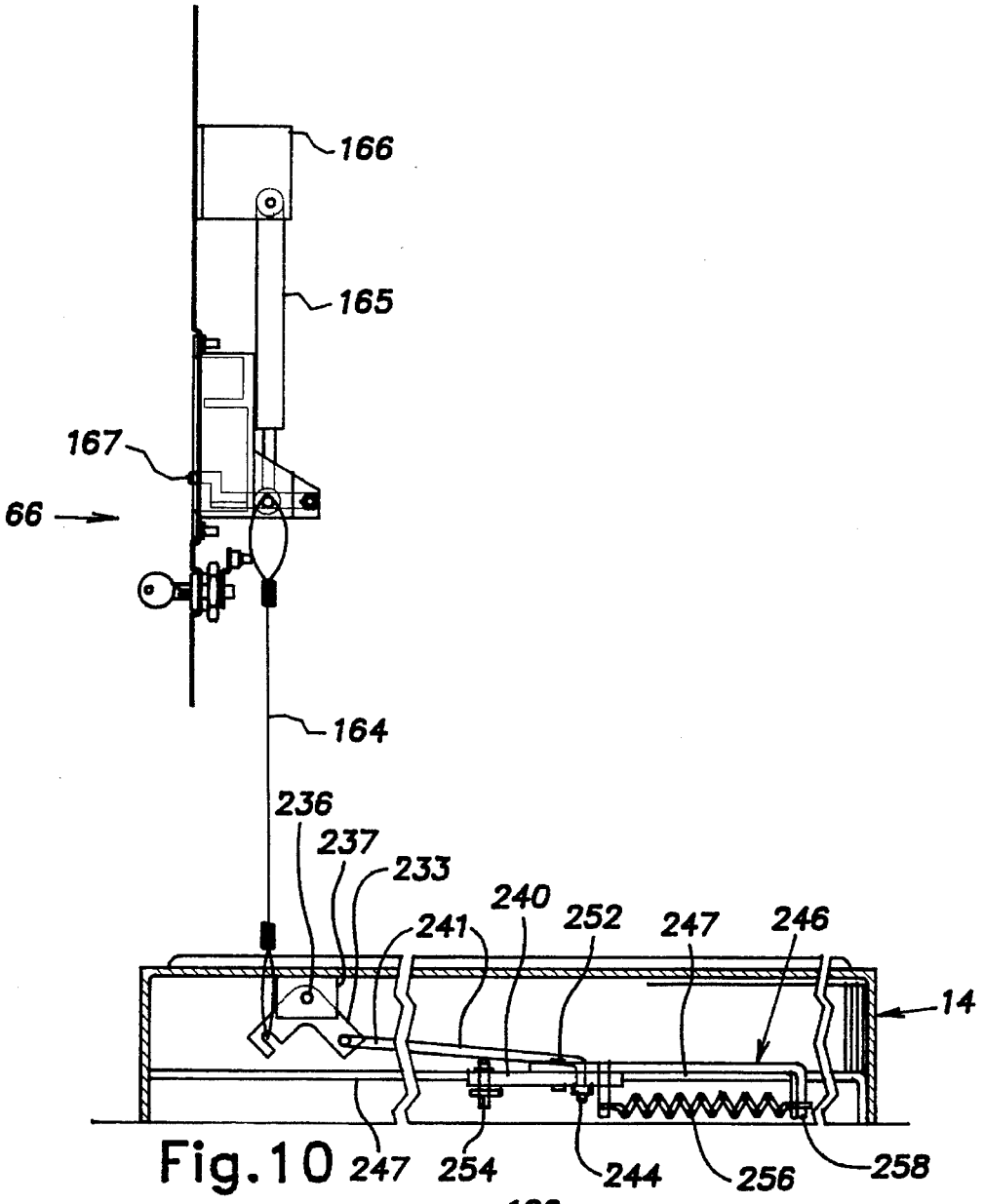
Figure 11:
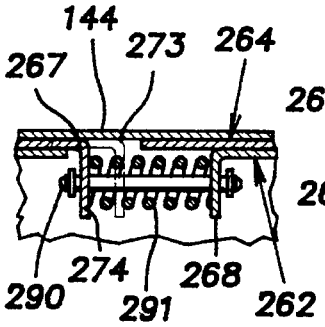
FIG. 11 is a detail view taken along the line 11—11 of FIG. 9.

FIGS. 4, 5, and 6 are enlarged views which show the structure at the bottom part of the module 10 and of the rotor 30. A bottom plate of the rotor 30 is designated at 120 of FIG. 5. The rotor bottom 120 has side flanges 122 and 124. A plate 126 has side flanges 130 and 132 and further edge flanges 134 and 136. Plate 126 is spaced as shown from the bottom plate 120, flanges 134 and 136 seating against the bottom 120 and the inside of flanges 122 and 124. Plate 126 has a circular ring-shaped depression 140 formed in it as shown which forms a part of a ball race for balls 142. The top of the bottom frame or base section 14 is designated at 144. The base top 144 has a similar circular ring-shaped depression 146 in it which is opposite to and complementary with the depression 140 so that the two together form a ball race which is circular in cross section for a plurality of balls 142.

The bottom plate 120 of the rotor 130 has a central depression 150. A pivot bolt 152 having a head 154 extends through an aperture in depression 150 and through a similar aperture in plate 126. The bolt 152 is threaded through a nut 158 which is welded to the plate 144 as shown. Between the depression 150 and the plate 126 is a bushing 160. As may be seen bolt 152 serves to center the rotor 130 and hold it in position with respect to base section 140. The entire rotor rests on the balls 142 in their race as described and is rotatable about the center formed by the bolt 152 which is aligned with axle 72.

A latch mechanism is provided within the base section 14 of module 10 for latching the rotor 30 in predetermined positions and for snubbing it, that is, restraining or retarding it after it has been rotated so as to control its momentum and stop it at a predetermined position. The retarding and latching mechanism is operable by the actuators 66 and 66*a*, one of which is on each side of the cabinet as shown. A tubular latching lever 170 has a flat end part 174 which is pivotally secured between brackets 176 and 178, as shown in FIG. 4. The lever 170 is movable angularly about its pivot point. An operating lever 161 is pivotably mounted to a beam 162 or other frame member (omitted from FIG. 5 for clarity) of the base 14. One end of the operating lever 161 is operatively connected to the free, movable end of the latching lever 170 by a link 163. The other end of the operating lever 161 is operatively connected to the actuator 66 by a link, such as a flexible cord 164 or rigid bar. A time delay mechanism, such as a piston in an air cylinder 165, is disposed between the actuator and a bracket 166 on the upright panel 42.

The actuator 66 comprises a slidable member having a handle 167 projecting through a slot 168 in the upright panel 42. The actuator 66 is slid upwardly by hand so as to pull the cord 164 and operate the lever 161 thereby moving the latching lever 170 downwardly. Return of the actuator to its lower position by gravity or a resilient device, such as a spring, is retarded by the air cylinder for a time which will become apparent from the discussion below. Telescopingly fitted on the lever arm 170 is sleeve 180 having end discs 182 and 184. Between the disc 182 and another disc or washer 186 on the lever 170 is coil spring 188. Washer 186 is held by a cotter pin. Between the end disc 184 and a bracket member 192 through which the lever arm 170 extends is another coil spring 194, the two coil springs serving to position the sleeve 180. Extending normal to the sleeve and carried by it is a pin or stem 200 which extends through a slot opening 202 in the plate 144 and a slot opening 204 in the plate 126 of the rotor 30. A second lever arm 208, similar to the lever 170, is disposed below the lever arm 170 as shown. The lever 208 has a similar, flat end part 210 pivotally mounted between brackets 212 and 214. It is angularly movable about its pivot point. Lever arm 208 passes through an aperture in the bracket 192. This bracket serves to link or couple the two lever arms together for purposes which will be explained.

A saddle 216 fits against the underside of lever arm 170. Projecting downwardly from edge parts of the saddle are guide stems, one of which is shown at 217, which serve as retainers for a pair of coil springs 218 and 219, the lower ends of which are biased against the bottom of the base section 14. These springs serve to bias the levers 170 and 208 into position as shown in FIG. 5 wherein the pin or stem 200 is engaged in the slot 204 in the bottom plate 126 of the rotor 30. Pin or stem 200 serves as a latch which holds the rotor 30 in any one of its four quadrant positions, there being four equally angularly spaced openings like opening 204 establishing the four quadrant positions. In order to release the rotor for rotation, either one of the actuators 66 or 66*a* can be actuated by hand. Thus, either the lever 170 or the lever 208 can be actuated around its pivot. If the lever 208 is actuated, its actuates the lever 170 through the coupling member 192. This draws the pin or stem 200 downwardly out of the opening in the plate 126 which permits the rotor to be rotated angularly on the ball race to one of its other positions. When the actuating lever is released, pin 200 will again move upwardly, but will be retarded by the air cylinder 165 to permit rotation of the rotor. After a time delay, the pin 200 will return to its upward position to engage in one of the openings in plate 126 to latch and hold the rotor as illustrated in FIG. 6. Since the rotor may have considerable momentum when the pin 200 engages in the opening, the pin and sleeve 180 will be moved axially along the tubular lever 170 as shown in FIG. 6 compressing one or the other of the coil springs 188 and 194. One of these springs serves to snub, that is, to restrain or retard, the movement of the rotor to hold it, and when the rotor is stopped, to position it in its correct latched position. The rotor can be rotated in either direction. The air cylinder permits sufficient time to rotate the rotor to a desired position before the rotor is latched.

The rotor of each of the modules 10, 10*a*, 10*b* can be similarly actuated by being rotated about its vertical axis, controlled by its respective actuator.

From the foregoing, those skilled in the art will understand the construction of the invention and its utilization. As may be seen in FIG. 1, module 10 is open, exposing filing shelves on two sides of the cabinet. Module 10*b* is shown rotated through ninety degrees so that two, flat smooth sides of its rotor form closures for that module. The rotor of module 10*a* is shown in an intermediate rotated position. The structure provides double banded files which, when open, expose an array of support shelving on two sides. In each rotated position where shelving is exposed, the entire array is exposed in that position for open shelf visibility. Access is provided from both sides and modules can be constructed to snap together or to be joined otherwise. As described, the rotation, that is, the movement of the rotors is controlled from either side of the cabinet. There are actuators for each module.

Referring to FIGS. 8 through 13, showing another embodiment of the invention, the base section 14 of the cabinet is like that of the previous embodiment. It has the top surface 144 and the ball race formed between this surface and plate 126 for balls 142 so that the rotor is supported as in the previous embodiment. Pivot bolt 152 is at the center of plate 126 and top surface 144 as in the previous embodiment.

The latching, snubbing or restraining means in the present embodiment comprises latching member or latching dog 220 in the form of a bell crank lever having nose 221 that can be extended through an arcuate slot 222 in surface 144 and a slot 145 in plate 126 for restraining the rotor. The latch member 220 is pivotally carried by a pivot member 224 extending between support members 225 and 226. The support members are disposed on an arcuate plate 228 having in it two arcuate slots 229 and 230. Plate 228 will be referred to again presently.

The latch member 220 is operable by the actuator 66 which is operatively attached to an operating lever 233 that is pivoted on a pivot member 236 on a bracket 237 disposed on a wall of the base 14. The actuator 66 is connected to the operating lever 233 by a link, such as a rigid bar 238 or a cord similar to that described above. The air cylinder 165 and bracket 166 are also provided as discussed above. The lever 233 is linked to a lever plate 240 by a link rod 241 an end of which extends through a hole in lever 233. The other link rod end 244 extends through a hole in lever plate 240. The lever plate 240 is pivoted to a floor or other part of the base 14 by a pivot member 252. The lever plate 240 is linked to the latch member 220 by way of a connecting link rod 254. A resilient device, such as a coil spring 256 is attached to a corner of the lever plate 240 and secured at the other end to a hole 258 in the base, for example. As may be readily seen, by lifting the actuator 66 the links and levers are actuated so as to rotate the latch member 220 about its pivot 224 as will be referred to again presently. The spring 256 biases the latch member to an upward position.

Figure 12:
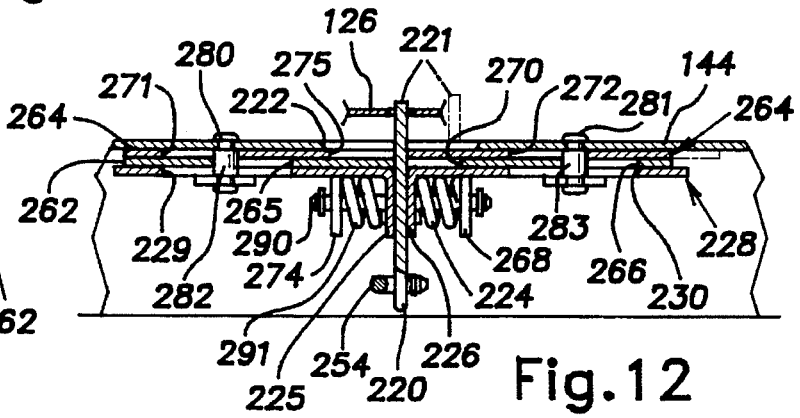
FIG. 12 is an arcuate sectional view taken along the line 12—12 of FIG. 8.

The latching mechanism, in addition to the plate 228, comprises additional plates 262 and 264 which are sandwiched together as shown in FIGS. 12 and 13. These plates are of similar arcuate shape. Plate 262 has arcuate slots 265 and 266 and it has a rectangular cut-out 267 with downwardly extending lug 268. Plate 262 also has an arcuate opening 270 in it.

Plate 264 has arcuate slots 271 and 272 and cut-out 273 from one edge of which projects a downwardly extending lug member 274 having arcuate opening 275.

The plates 228, 262, and 264 are held in overlying or sandwiched relationship underneath the plate 144 as may be seen in FIGS. 8, 9 and 12. The numerals 280 and 281 designate a pair of pins headed at both ends and with a neck smaller in diameter adjacent to the head at each end. These pins have an intermediate body part of slightly larger diameter as designated at 282 and at 283. These pins extend through the surface 144 as shown in FIG. 12, pin 280 extending through the slots 271, 265 and 229 in the plates 264 and 262 and 228, respectively. A lug 274 on the plate 264 and a lug 268 on the plate 262 come into position oppositely to each other as may be seen in FIG. 11 and 12. Extending between these two lugs 268, 274 through openings therein is a rod or stem 290 and surrounding the stem between the lugs 274 and 268 is coil spring 291. The spring 291 is compressed when the lugs 274 and 268 are moved toward one another.

The relationship of the latch member 220 and the plates shown in FIG. 13 to the surface 144 of the base 14 and plate 126 is shown in FIGS. 9 and 12. The assembly of plates shown in FIG. 13 is a floating assembly. The plate 228 carrying the latch member 220 can move arcuately, the slots 229 and 230 guiding movement by engagement with pins 280 and 281. In the position of the parts as shown in FIG. 12, the latch member 220 is at the right hand extremity of the arcuate slot 275 in plate 264 and is at the left hand extremity of the slot 270 in the plate 262. In other words, the slots 275 and 270 overlap enough to provide a slot passageway through both of them to receive the latch member 220 as shown in FIG. 12. In the position of FIG. 12, latch member 220 is at the center of the slot opening 222 in surface 144. From this position, the latch member can move to either end of the arcuate slot 222. As previously described, if actuator 66 is lifted, latch member 220 is operated to the position shown in phantom in FIG. 9. When the actuator 66 is released, the latch member 220 is operated into the engaged position of FIG. 9 by the spring 256 so that the nose 221 goes through the slot 145 in the plate 126 to restrain the rotor. The return of the latch 220 to the engaged position is retarded by the air cylinder 165. During the time that the latch is returning to the engaged position, the rotor can be rotated to a desired position. Then the operation is as follows. Momentum of the rotor may cause the plate 126 which is now engaged with the nose 221 of the latch member 220 to force it to the right as shown in FIG. 12 to the dotted line position. The latch member 220 now forces the plate 264 to the right until the pins 282 and 283 engage the left extremity of the slots 271 and 272. This movement of plate 264 moves lug 274 to the right against the force of, thereby compressing, spring 291 which provides the necessary retarding and snubbing action to resist the momentum of the rotor. At this time, the lug 268 on plate 262 stays in position being unable to move to the right from the position of FIG. 12 because pins 280 and 281 are at the left extremity of slots 265 and 266. As previously explained, latch member 220 is carried by plate 228 which is able to slide arcuately, the arcuate slots 229 and 230 sliding on the pins 280 and 281. The latch, and therefore the rotor, then return to the neutral position, shown in FIG. 12, and are held there by springs 224 and 291.

From the foregoing, it can be observed that the mechanism for latching the rotor and resiliently retarding it to overcome its momentum and holding it in a latched position is simplified and will stop the rotor in a predetermined position, with the latch member in the position of FIG. 12. The parts are relatively small occupying only a minor part of the circumference of the rotor with the operating mechanism being very sturdy and positive. Of course, if desired, the latch member 220 can be arranged to be operable from either one side or both sides. The hand operated actuator provides a simple and easily accessible means for unlocking the rotor to permit rotation thereof. The time delayed re-engagement of the latch permit a user sufficient time to access a desired location of the rotor. In addition, both hands are free to operate the rotor and retrieve materials. The unlatching procedure does not require the use of either foot.

The present disclosure describes several embodiments of the invention, however, the invention is not limited to these embodiments. Other variations are contemplated to be within the spirit and scope of the invention and appended claims.

What is claimed is:

1. A latching device for a rotor of a cabinet, comprising:

an actuator;

a generally vertically extending, vertically elongated link having a top end and a bottom end, said top end being operatively connected to the actuator;

a movable latch adapted to engage between the cabinet and a rotor of the cabinet so as to restrain rotation thereof;

a bias device for urging the latch toward its engaged position; and a linkage connected to the bottom end of the link and to the latch to translate motion of the actuator so as to cause disengagement of the latch, wherein the actuator is disposed above the linkage and the link extends substantially vertically between the linkage and the actuator.

2. A latching device according to claim 1, wherein the latch engages the rotor so as to position the rotor.

3. A latching device according to claim 1, further comprising a hand operable handle disposed on the actuator.

4. A latching device according to claim 1, wherein the actuator is vertically slidable.

5. A latching device according to claim 1, further comprising a delay mechanism for retarding return of the latch to its engaged position after disengagement.

6. A latching device according to claim 5, wherein the delay mechanism comprises a piston disposed in an air cylinder.

7. A latching device according to claim 1, wherein the linkage comprises:

an operating lever operatively connected to the actuator; and a generally horizontally disposed, elongated link having a first end operatively connected to the operating lever and a second end operatively connected to the latch so as to translate movement of the actuator to movement of the latch.

8. A latching device according to claim 7, wherein the linkage further comprises a lever plate operatively connected between the latch and the horizontal link so as to translate motion of the horizontal link in one direction to motion of the latch in another direction.

9. A latching device according to claim 1, wherein the latch is resiliently mounted so as to apply a resilient stopping force to the rotor when the latch engages the rotor.

10. A latching device according to claim 9, further comprising a resilient device urging the latch toward a neutral position when engaged with the rotor.

11. In a rotary cabinet comprising:

a cabinet; a rotor adapted for storage and rotatably mounted in the cabinet; and a base above which the rotor is mounted;

a latch mechanism, comprising:

a latch member mounted on the base, housed by the base and movable to a rotor engaging position so as to restrain movement of the rotor;

a generally vertically extending, vertically elongated link operatively connected to the latch member;

a bias device urging the latch member toward its rotor engaging position; and an actuator operatively connected to the latch member by the elongated link so as to disengage the latch member by movement of the actuator, the actuator being vertically spaced above the base.

12. A rotary cabinet according to claim 11, further comprising a delay mechanism for retarding return of the latch member to its engaged position after disengagement.

13. A rotary cabinet according to claim 12, wherein the delay mechanism comprises a piston disposed in an air cylinder.

14. A rotary cabinet according to claim 11, wherein the latch member is resiliently mounted on the base.

15. A rotary cabinet according to claim 11, wherein the latch member is mounted so as to resiliently apply stopping resistance to the rotor when the latch member is in its rotor engaging position.

16. A rotary cabinet according to claim 11, wherein the latch member is engageable with the rotor to resiliently apply stopping resistance thereto to stop movement of the rotor and restrain the rotor to a predetermined stopping position.

17. A rotary cabinet according to claim 11, further comprising a spring; a first member engageable by the latch member on lateral movement in one direction, the first member being attached to one end of the spring; a second member engageable by the latch member on lateral movement in the opposite direction and attached to the opposite end of the spring; and a stop limiting movement of the first and second members so that when either end of the spring is being compressed, the other end is restrained.

18. A rotary cabinet according to claim 17, wherein the members attached to the spring comprise first and second overlying plates and further comprising an interconnection permitting limited relative movement of the plates and permitting limited lateral movement of the latch member.

19. A rotary cabinet according to claim 18, wherein the interconnection comprises pins disposed through slots in the plates.

20. A rotary cabinet according to claim 18, further comprising a third plate on which the latch member is mounted.

21. A rotary cabinet according to claim 11, wherein the cabinet has two sides opposite each other which are open; and the rotor comprises a rectilinear, platform support mounted in the cabinet and rotatable about a vertical axis to positions providing access to the platform support through either of the open sides.

22. A rotary cabinet according to claim 11, further comprising a circular support track for the rotor.

23. A rotary cabinet according to claim 11, further comprising a plurality of shelves disposed on the rotor.

24. A latching device according to claim 11, wherein the actuator is vertically slidable.

25. A latching device for a rotor of a cabinet, comprising:

an actuator;

a link operatively connected to the actuator;

a movable latch adapted to engage between the cabinet and a rotor of the cabinet so as restrain rotation thereof;

a bias device for urging the latch toward its engaged position;

a linkage connected between the link and the latch to translate motion of the actuator so as to cause disengagement of the latch; and a delay mechanism for retarding return of the latch to its engaged position after disengagement.

26. In a rotary cabinet comprising:

a cabinet; a rotor adapted for storage and rotatably mounted in the cabinet; and a base above which the rotor is mounted;

a latch mechanism, comprising:

a latch member mounted on the base and movable to a rotor engaging position so as to restrain movement of the rotor;

a bias device urging the latch member toward its rotor engaging position;

an actuator operatively connected to the latch member so as to disengage the latch member by movement of the actuator; and a delay mechanism for retarding return of the latch member to its engaged position after disengagement.

* * * * *